US006484954B2

(12) United States Patent
Lenox

(10) Patent No.: US 6,484,954 B2
(45) Date of Patent: Nov. 26, 2002

(54) METHOD AND DEVICE FOR SURGICAL BONE GRINDING

(75) Inventor: Linda Lenox, Longmont, CO (US)

(73) Assignee: Lenox-MacLaren Surgical Corp., Louisville, CO (US)

( * ) Notice: Subject to any disclaimer, the term of this patent is extended or adjusted under 35 U.S.C. 154(b) by 20 days.

(21) Appl. No.: 09/733,124

(22) Filed: Dec. 8, 2000

(65) Prior Publication Data

US 2002/0070299 A1 Jun. 13, 2002

Related U.S. Application Data

(60) Provisional application No. 60/170,006, filed on Dec. 9, 1999.

(51) Int. Cl.[7] ..... B02C 19/12

(52) U.S. Cl. ..... 241/30; 241/169.1; 241/235; 241/277

(58) Field of Search ..... 241/169.1, 277, 241/235, 30

(56) References Cited

U.S. PATENT DOCUMENTS

| | | | | |
|---|---|---|---|---|
| 838,370 A | | 12/1906 | Belt et al. | |
| 1,132,976 A | | 3/1915 | Roggenmoser | |
| 2,048,509 A | | 7/1936 | Melcher et al. | |
| 3,856,219 A | * | 12/1974 | Stayton et al. | 241/263 |
| 4,706,897 A | * | 11/1987 | Moeller | 241/100 |
| 5,511,729 A | | 4/1996 | Husain | 241/46.01 |
| 5,676,321 A | | 10/1997 | Kroger | 241/236 |
| 5,730,372 A | * | 3/1998 | Bradley | 241/152.2 |
| 6,287,312 B1 | * | 9/2001 | Clokie et al. | 606/85 |

* cited by examiner

*Primary Examiner*—Mark Rosenbaum
(74) *Attorney, Agent, or Firm*—Sheridan Ross P.C.

(57) ABSTRACT

A method and apparatus for grinding bone for use in orthopaedic procedures includes a bone shoot for receiving bone segments which are fed into a grinding assembly rotatable about an axis such that a plurality of cutting plates rotate about such axis to grind bone into uniform and desirable sized portions suitable for use in cementing of bone implants.

34 Claims, 5 Drawing Sheets

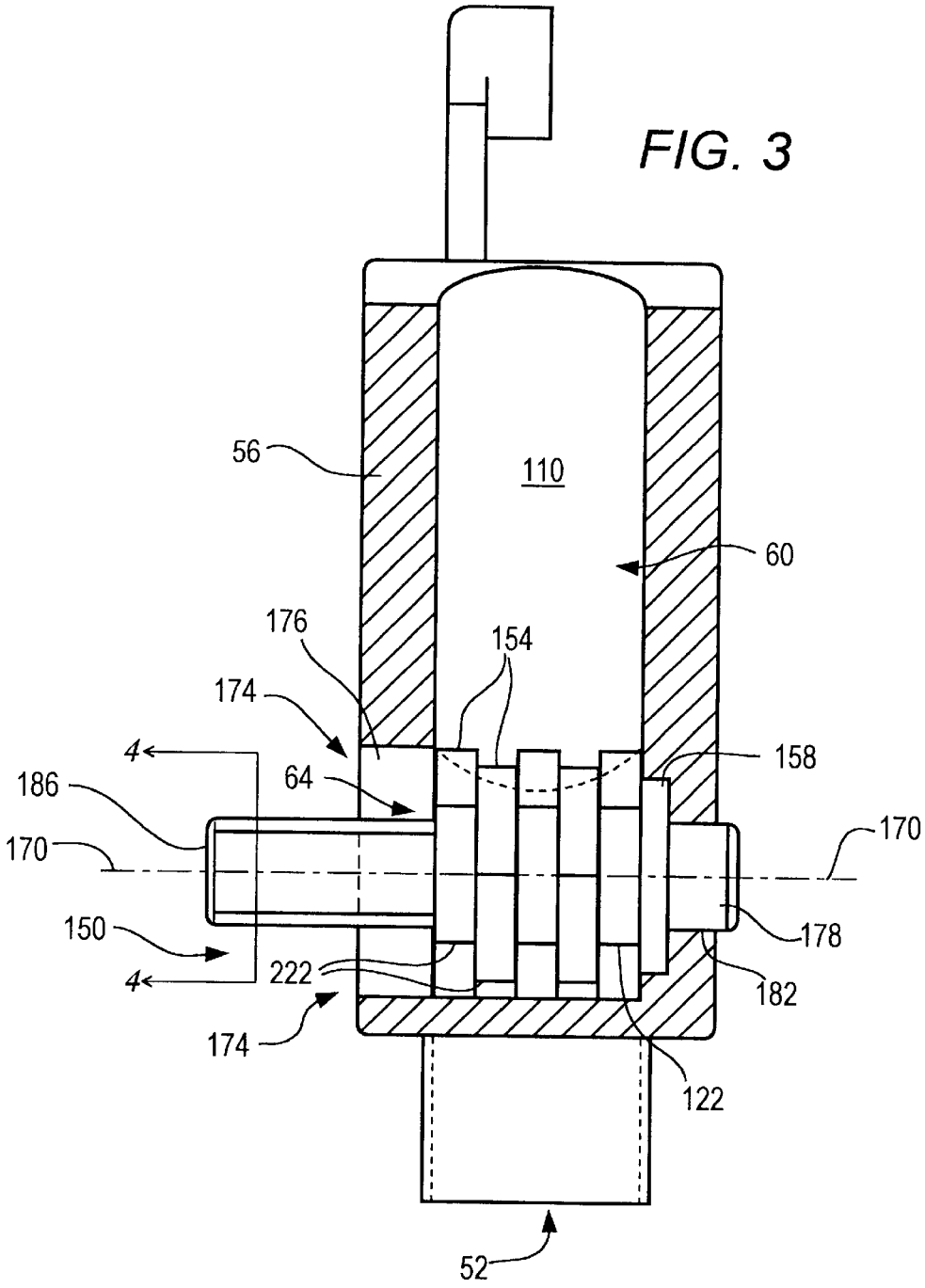
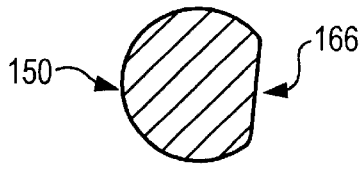
FIG. 4

METHOD AND DEVICE FOR SURGICAL BONE GRINDING

RELATED APPLICATION

This application claims priority from U.S. Provisional Patent Application No. 60/170,006 filed on Dec. 9, 1999. The entire disclosure of the provisional application is considered to be part of the disclosure of the accompanying application and is hereby incorporated by reference.

FIELD OF THE INVENTION

The present invention is directed to a method and apparatus for grinding bone for use in orthopaedic procedures.

BACKGROUND OF THE INVENTION

Various bone grinding devices are known in the art utilizing a variety of mechanisms in order to achieve a desired particle size of bone. Many of such devices are powered with a motor whereas others are manually driven by a hand crank. The size, expense and weight of available bone grinders, however, limit their practical application. Moreover, many of such bone grinders do not consistently produce bone particles of a uniform size which is deemed necessary in order to achieve desired tissue growth once the ground bone particles are placed adjacent to a surgical implant. Other prior art devices are prone to jam during cutting and grinding operations and motorized devices are often too heavy and cumbersome to provide easy access by a surgeon in an operating room environment. Still other bone grinding devices suffer from the fact that the grinding operation destroys bone cells such that a significant portion of the ground bone fraction is unusable for its intended purpose of promoting additional bone growth around surgical implants.

There is therefore a long-felt, but unsolved need in the industry to provide a method and system for grinding bone in a fashion that generates bone fragments of a desired size such that such bone fragments can be used in the regeneration of bone tissue surrounding surgical implants. Preferably, such a device would be relatively lightweight, be manually operated to facilitate use in various operating environments and would have a grinding mechanism that permits easy cleaning/autoclaving in order to ensure the requisite sterile nature of surgical instruments.

SUMMARY OF THE INVENTION

The present invention is a novel bone grinder for use in orthopaedic procedures such as in surgical procedures where bones are removed from one portion of a patient's body, and subsequently ground so that the resulting bone fragments may be utilized to augment or repair defects in other areas of the patent's skeletal system. The bone grinder of the present invention provides bone fragments of a preferred size, wherein substantially 100% of the bone segments provided to the present invention are transformed into appropriately sized bone fragments. Moreover, the present invention performs such uniform grinding on substantially all sizes and types of bone using a novel arrangement and configuration of bone cutting teeth on a rotatable bone grinding assembly, wherein the cranking force for rotating the grinding assembly effectively to grind bones input into the present invention can be readily manually applied by even petite medical professionals.

The novel bone grinding assembly of the present invention has a configuration of novel bone cutting teeth that is particularly useful in grinding bones via a manual cranking operation. In particular, the grinding assembly includes a plurality of bone cutting plates, each having a plurality of teeth on their outer circumference, wherein the cutting plates are positioned in contacting fixed alignment to one another on a rotatable shaft of the grinding assembly. Moreover, the configuration of cutting teeth on a fully assembled grinding assembly is such that there is: (a) relatively small amount of the total number of teeth contacting and cutting the input bone segments at any one time during operation, and (b) the arrangement of cutting teeth on immediately adjacent cutting plates is such that the teeth are offset circumferentially around the rotatable grinding shaft whereby each tooth is able to take advantage of a preceding cut made into a bone segment by an immediately adjacent tooth. That is, since each tooth both cuts into the bone segments as well as shears the bone segments along the tooth sides perpendicular to the tooth's cutting edge, and since the cutting teeth are both offset radially around the grinding shaft and have immediately adjacent cutting paths, substantially every tooth upon contacting the bone segments already has one tooth side that has been sheared by a preceding adjacent tooth. Thus, each tooth substantially shears (unassisted by adjacent teeth) the bone from the bone segments on at most a single side of the cutting tooth. Moreover, the configuration of the cutting teeth are such that each cutting tooth cuts (along its cutting edge) and shears (along a tooth side) bone fragments having substantially the desired size without fracturing these bone fragments into unacceptably small sizes.

It is also an aspect of the present invention that the bone grinding assembly, as well as all other bone contacting portions of the present invention, may be manufactured and assembled without any welds coming in contact with bone matter. In fact, it is an aspect of at least some embodiments of the present invention that it can be manufactured without any welds whatsoever. Note that this lack of welds is advantageous in that bone matter or other contaminants from, e.g., a previous use of the present invention can become entrapped in or about such welds and thereby in a subsequent operation, compromise the purity of the bone fragments produced by the present invention.

It is a further aspect of the present invention that the cutting plates, and indeed the entire grinding assembly, can be easily removed from the bone grinder of the present invention. In particular, each of the cutting plates of a grinder assembly have a central opening therethrough for sliding uniquely and fixedly onto the grinding shaft. Thus, since the adjacent side-to-side contact of the cutting plates extends substantially the entire width of the grinding chamber residing within the bone chute, the cutting plates remain in proper alignment without the use of welds or other techniques for fixing the position of cutting plates within the bone grinding assembly. Further note that each collection of cutting plates used together in an assembled grinding assembly may be slightably replaced upon the grinding shaft by a different such collection of cutting plates for providing a different size of resulting bone fragments, and/or easily replacing a dulled or chipped collection or any cutting plates within a collection.

It is a further aspect of the present invention that a gear box is provided thereon for increasing the cutting force that is applied by, for example, a manual crank for the present invention. In particular, the Applicant has discovered that the present invention effectively grinds bones, via a manual cranking operation, by utilizing a gear reduction of approximately 2.4 to 1.

It is a further aspect of the present bone grinder that it is sufficiently lightweight (approximately less than 20 lbs and preferably less than about 15 lbs, in one embodiment approximately 14 lbs), and compact in size so that the entire device can be sterilized in, e.g., an autoclave. Moreover, such repeated sterilization will not affect the performance of the bone grinder in that there are no parts that are subject to degrading during harsh sterilization techniques, and the bone grinder of the present invention neither requires nor uses any lubricants.

It is a further aspect of the present invention that the plunger used to force bone segments toward and into contact with the bone grinding assembly is connected, via a linkage 102 assembly, to an ergonomically designed handle that allows an operator to maintain uniform pressure on the bone segments within the bone chute by lightly squeezing a trigger-like handle oriented at approximately 30° to 60° from horizontal. Thus, even petite operators may easily maintain an effective pressure on the bone segments within the bone chute with one hand while operating a manual crank of the present invention with the other hand for thereby producing appropriately sized bone fragments. Moreover, a hand held bone grinding (sub)assembly of the bone grinder is removable from a base upon which the hand held assembly may be mounted. Accordingly, the hand held assembly of the present invention as capable of being used both on the base as well as when detached from the base.

It is a further aspect of the present invention that once bone fragments have been cut away from the input bone segments, such bone fragments readily exit the bone grinder and thereby do not clog the grinding assembly or the bone fragment exiting portion of the bone chute. In particular, the exiting portion of the bone chute is vertical and short in length (e.g., in the range of 1 inch to 4 inches, preferably less than about 2 inches). Moreover, the bone cutting teeth of the grinding assembly, even though configured to scoop an appropriate volume of bone material from the bone segments, has a relatively shallow convex leading face so that the reduced surface area and the centrifugal force from the rotating of the grinding assembly tends to eject the bone fragments vertically downward and through the short bone fragment exiting portion of the bone chute without sticking to the interior of the bone grinder. The grinding teeth are preferably made of hardened steel and are honed until very sharp.

Other features and benefits of the present invention will become evidence from the accompanying drawings and detailed description.

BRIEF DESCRIPTION OF THE DRAWINGS

FIG. 3 is a cut away view of the grinding house 56 as indicated by labels "3" in FIG. 2. FIG. 3 shows the input portion 110 of the bone chute 60, and the grinding assembly 64 within the bone chute.

FIG. 4 is a cross section of the grinding shaft 150 showing the key portion 166.

DETAILED DESCRIPTION OF THE PREFERRED EMBODIMENT

Figure 1:
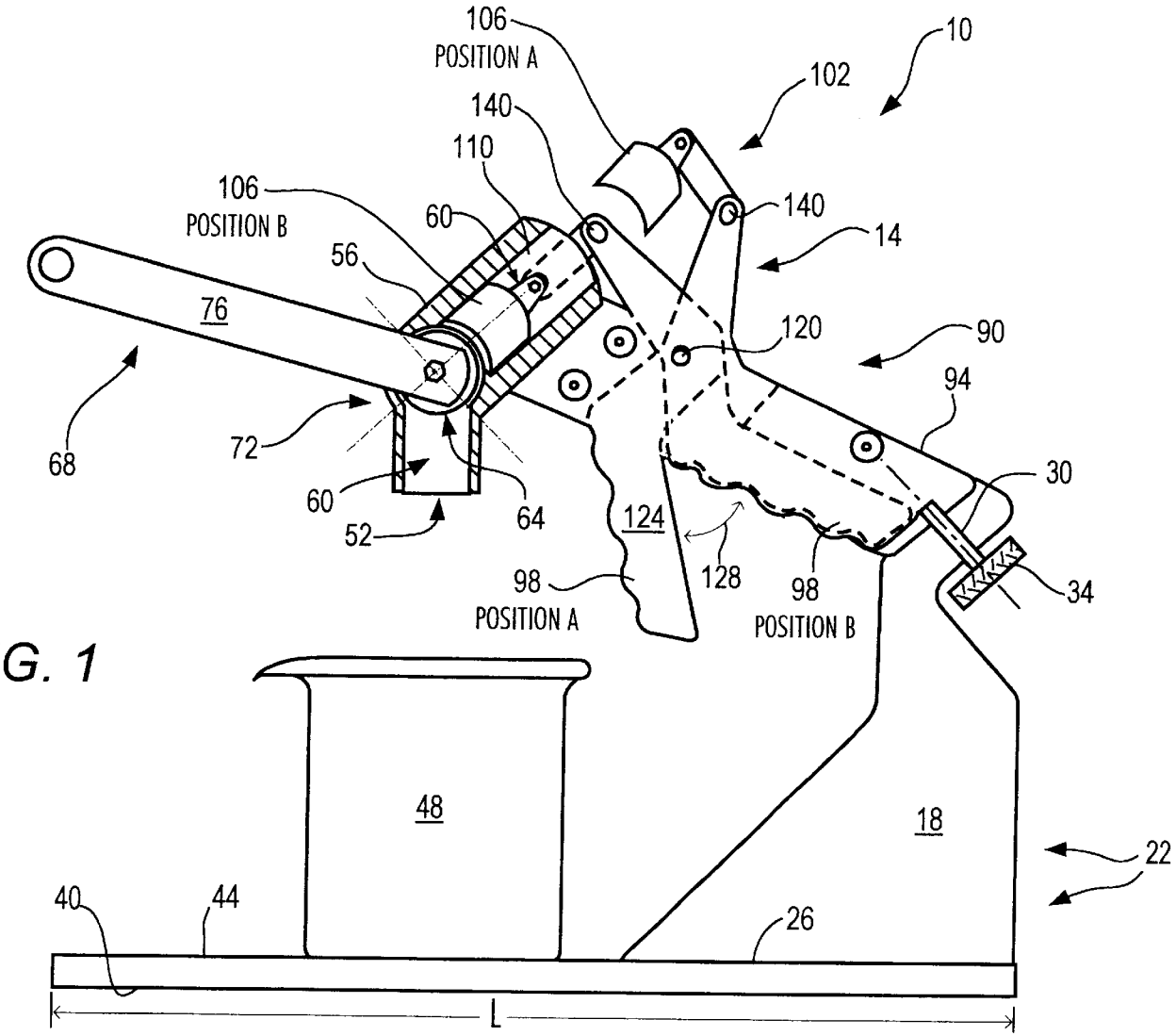
FIG. 1 is a side view of the present invention showing a cross section through the grinding house 56 for illustrating the bone chute 60 and the grinding assembly 64.

In FIG. 1 a side view of the bone grinder 10 of the present invention is shown. The bone grinder 10 includes a hand held bone grinding assembly 14 which is attached to a base 22, wherein the base has a base plate 26 and a mount 18 attached to the base plate. The hand held assembly 14 (a view of its opposite side also being shown in FIG. 2) is detachable from the mount 18 by, e.g., unthreading a threaded shaft 30 having a hand turnable head 34 so that the shaft 30 only resides in the mount 18 and does not enter corresponding threaded bore within the hand held assembly 14.

The base 22, in one embodiment, is made of stainless steel, wherein the base plate 26 has substantially planar bottom and top sides 40 and 44 respectively. Further, each of the bottom and top sides 40 and 44 may be rectangular in shape having, e.g., a length L of approximately 9 inches, and a width (not shown) of approximately 6 inches. Thus, as can be ascertained from FIG. 1, the bone grinder 10 of the present invention is relatively small in size (having a height of approximately 8 inches), and additionally, can be easily hand carried between operating rooms and/or sterilization devices, such as an autoclave, wherein the entire bone grinder 10 may be provided for sterilizing. Additionally note that the base plate 26 can provide a suitable platform for positioning a receptacle 48, wherein bone fragments of a desired size exit the hand held assembly 14 via the bone fragment exit 52.

Figure 2:
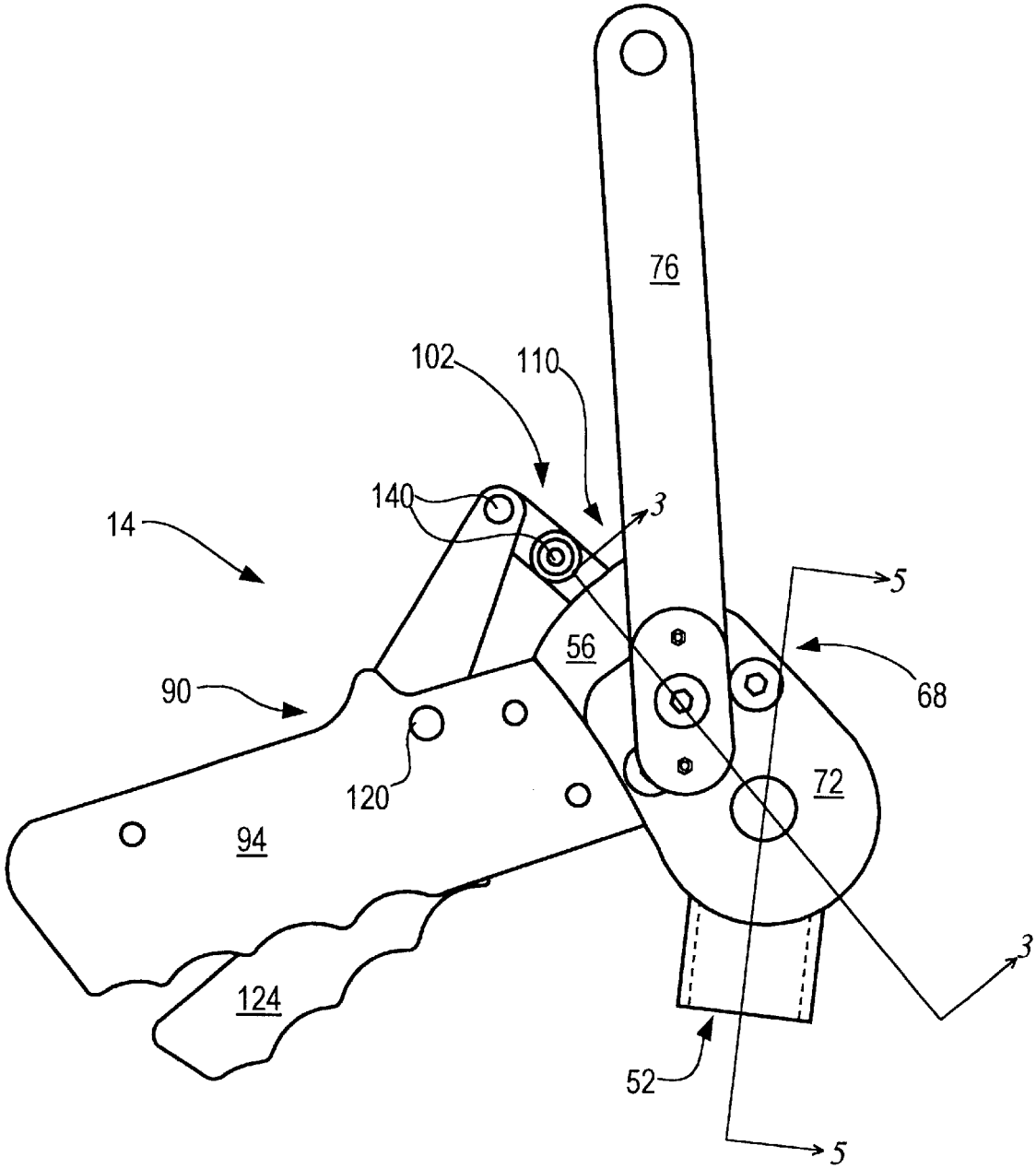
FIG. 2 is a side view from the opposite side from that of FIG. 1, wherein only the hand held assembly 14 is shown.

The hand held assembly 14 includes a grinding housing 56 having a bone chute 60 therein for receiving bone segments to be ground by a rotatable grinding assembly 64 also provided within the housing 56. Referring to FIGS. 1 and 2, the housing 56 has attached thereto a crank assembly 68 that in at least one embodiment, can be manually operated to rotate the grinding assembly 64 for grinding bone. The crank assembly 68 includes a gear box 72 having a crank attachment 74 protruding therefrom upon which an end of the crank arm 76 is attached for rotating the crank attachment 74. The crank attachment, in operation, is used to rotate the grinding assembly 64 via a series of reduction gears within the gear box 72 such that gear reductions in the range of 2:1 to 4:1 are provided therein. In particular, the Applicant has discovered that such gear reduction ratios for grinding bone with the present invention provides properly sized bone fragments from substantially any type of bone by exerting approximately 3 to 5 lbs at the free end of the crank arm 76 wherein the crank arm is approximately 5 to 6 inches in length. Accordingly, an effective amount of properly sized bone fragments can be produced in approximately 1 to 5 minutes by an operator manually rotating the crank arm 76 at approximately 60 revolutions per minute.

The grinding housing 56 is also attached to a hand grip assembly 90 which, in turn, is attached to the mount 18 via the threaded shaft 30. The hand grip assembly 90 includes a grip 94 extending at an angle of approximately 30° to 60° from the horizontal from its attachment to the mount 18. Additionally, the assembly 90 also includes a lever 98 and a linkage assembly 102 for a slidable moving a plunger 106 within the bone chute 60, wherein this plunger is shaped and sized to substantially entirely fill a cross section of the input portion 110 of the bone chute 60. Thus, the plunger 106 is able to apply pressure to the bone segments between the plunger and the grinding assembly 64 for maintaining the bone segments in contact with the grinding assembly. The lever 98 is pivotally mounted on pivot pin 120, wherein the finger grip portion 124 pivots in the directions of arrow 128 between a first position (labeled position A) and a second position (labeled position B). Note that the lever 98 pivots about pivot pin 120 within a slot (not shown) of the hand grip assembly 90, wherein the slot substantially encloses, within the hand grip assembly 90, the finger grip 124 when the finger grip is in position B. Accordingly, the portion of the lever 98 extending from the finger grip 124 to the pivot pin 120 pivots from: (a) being fully enclosed within the slot of the hand grip assembly 90 (corresponding to position B of the finger grip) to (b) being only partially enclosed within the grip 94 as, e.g., when the finger grip 124 is in position A.

The portion of the lever 98 on the opposite side of the pivot pin 120 from that of the finger grip 124 is pivotally connected at pivot pin 140 (shown in FIG. 1 in two positions corresponding to positions A and B of the lever 98) for connecting to the plunger linkage 102, wherein this linkage in combination with the pivotal movement of the lever 98 causes the plunger 106 to slide within the input portion 110 of the bone chute 60 without binding therein.

FIG. 3 shows a cross section of the grinding housing 56 according to the sectioning plane 3 as indicated in FIG. 2. In particular, FIG. 3 shows a fully assembled grinding assembly 64 provided within the grinding housing 56. The grinding assembly 64 includes a grinding shaft 150 that extends through the grinding housing 56, and upon which a plurality of bone cutting plates 154 are provided in fixed alignment to one another. The grinding shaft 150 includes a plate stop 158 substantially adjacent end 178 of the grinding shaft 150, wherein the plate stop contacts an end cutting plate 154 of the series of vertically aligned and mutually contacting (i.e., contiguous) cutting plates. Note that the grinding shaft 150 also includes a keyed portion 166 thereon, wherein the grinding shaft is substantially cylindrical with the exception of a keyed portion 166. Accordingly, since the keyed portion 166 may be flattened or recessed, a central opening 198 (FIG. 6) piercing the center portion of each of the cutting plates 154 matches a cross section of the grinding shaft 150 traverse to the grinding shaft axis 170 (such as at the cross sectioning plane indicated by the label "4" in the present figure and shown face on in FIG. 4). Accordingly during assembly, the cutting plates 154 sequentially slide onto the grinding shaft 150 through their central openings 198 thereby assuring that each cutting plate must rotate in unison with the rotation of the grinding shaft 150 in that the mated keyed portion 166 and the central openings prevent the cutting plates from rotational slippage when the grinding shaft 150 rotates. Additionally, the cutting plates 154 can be slidably removed from the grinding shaft 150 for replacement and/or repair.

Further note that during assembly of the bone grinder 10, the grinding shaft 150 with the plurality of grinding plates 154 thereon may be inserted into the grinding housing 56 via an opening 174 into a chamber 176 (FIGS. 3 and 5) that is substantially cylindrical and traverses through the bone chute 60 wherein the shaft end 178 of the grinding shaft 150 is inserted into a compound bore 182 within the grinding housing 156 such that this compound bore substantially mates with the shaft end 178 and the plate stop 158. Thus, the sequentially contiguous cutting plates 154 substantially entirely fill the cylindrical portion of the chamber 176 that extends across an end of the input portion 110 of the bone chute 60. Moreover, during assembly, the opening 174 is snugly sealed with an annular insert portion 190 (FIG. 5) of the gear box 72, wherein the insert portion has an outer diameter substantially equal to the diameter of the opening 174 and an inner opening therethrough that is of sufficient diameter to fit over the grinding shaft 150 such that the grinding shaft can readily rotate when the shaft end 186 mates with a recess within a driving gear 194 (FIG. 5) of the gear box 72 such that the keyed portion 166 extends into the mating portion of the driving gear.

Figure 5:
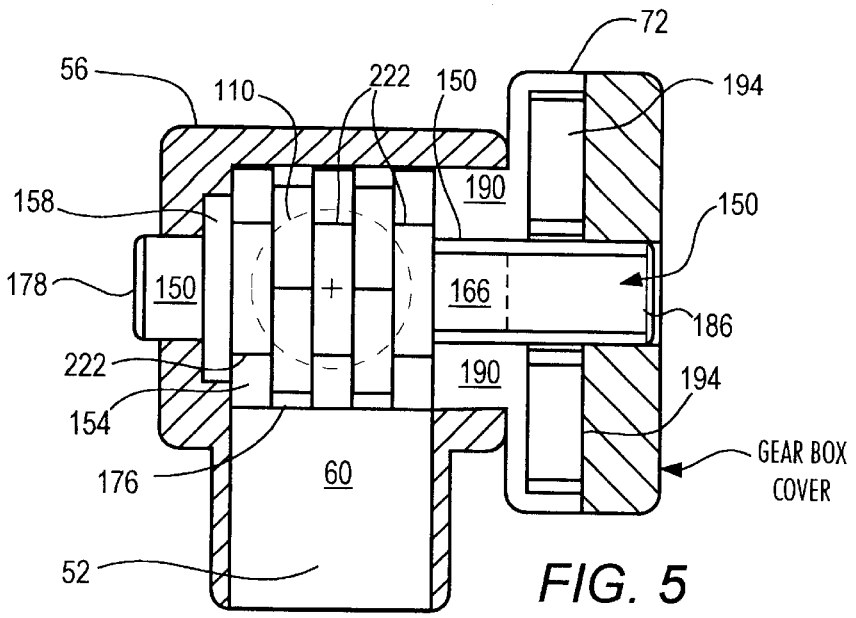
FIG. 5 is a cut away view of the grinding housing 56 as indicated by the labels "5" in FIG. 2.
Figure 6:
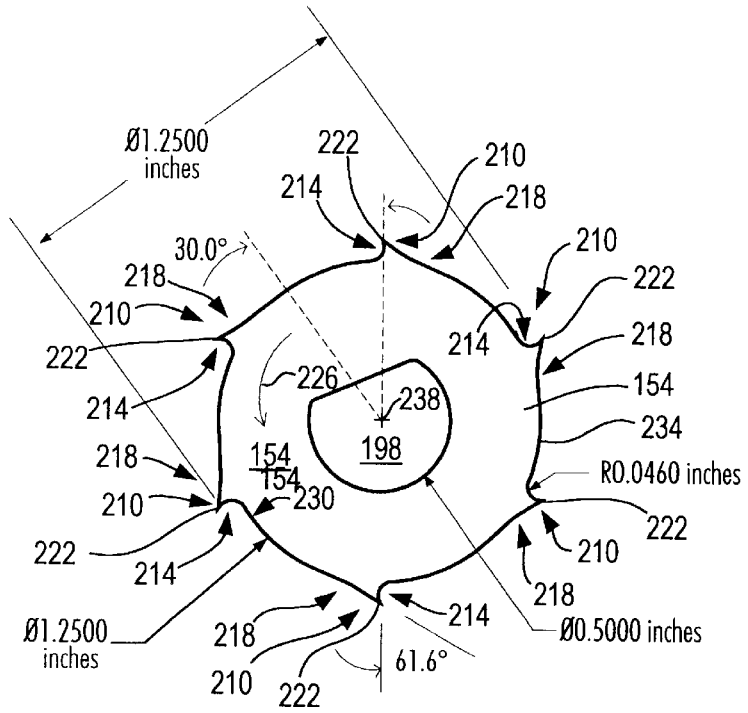
FIG. 6 is a side view of a cutting plate 154.
Figure 7:
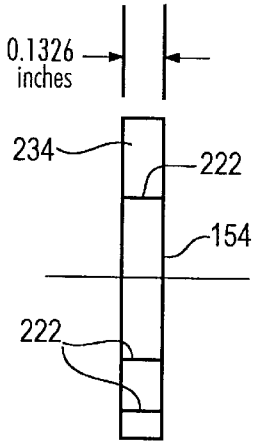
FIG. 7 is an edge view of the cutting plate 154 shown in FIG. 6.

Returning now to the contiguous series of cutting plates 154 as shown in FIGS. 3 and 5, each cutting plate 154 substantially resembles, in at least one embodiment, the cutting plate 154 shown in FIGS. 6 and 7. Accordingly, each such cutting plate 154 has a central opening 198 therethrough which is a silhouette of the grinding shaft 150 cross section as shown in FIG. 4. Each cutting plate 154 also has a plurality of bone cutting teeth 210 on an outer rim 234, wherein each such tooth has a leading face 214, a trailing face 218, and a cutting edge 222 facing generally in the direction of cutting blade 154 rotation (i.e., in the direction of arrow 226). In the cutting plate 154 embodiment of FIGS. 6 and 7, there are six such cutting teeth 210 evenly spaced upon the outer rim 234 of the cutting plate 154. However, a fewer or greater number of teeth 210 may be dispersed about the outer rim 234 of such cutting plates 154. Moreover, the number of teeth 210 per cutting plate 154 can be depend upon the diameter of such cutting plates, which in the embodiment of FIGS. 6 and 7 is 1.25 inches. Moreover, note that at least some of the cutting edges 222 are shown on the cutting plates 154 of FIGS. 3 and 5.

It is believed that the general configuration of each cutting tooth 210 is an important feature of the present invention in allowing a manual cranking force to cut through substantially any type of bone without chipping the teeth, and without clogging the front face 214 area with bone matter during operation of the bone grinder 10. In particular, Applicant has discovered that a shallow concave curve in the leading face 214 of, e.g., approximately 0.046 inches for the embodiment shown in FIGS. 6 and 7 produces a leading face to which bone matter does not excessively adhere, and therefore will readily detach from the leading face when gravity and the centrifugal of the rotating grinding assembly 64 combine to urge such bone matter downwardly through the bone fragment exit 52 (FIG. 1). More generally, it is believed that if the concave curve of the leading face 214 causes substantially no portion of this leading face to be on a trailing side of a radius from the center point 238 to the tooth edge 222 (FIG. 6), then there is a reduced likelihood of the teeth 210 becoming clogged with bone matter during operation. Additionally, it is believed that a slight convex rim contour just preceding each leading face 114 (according to the rotation of the cutting plate 154 as indicated by the direction of arrow 226 of FIG. 6) both facilitates the strengthening of the teeth 210 as well as assists in reducing clogging of the leading faces 214. Such a slight convex contour is illustrated in FIG. 6 as having a curvature corresponding to a radius of 0.55 inches in, e.g., a convex region 230 along the rim 234. In particular, each convex region 230 smoothly blends into the concave curve of the leading face 214 of the immediately trailing tooth 210, and at the opposite (leading) end of the convex region, it smoothly blends into a substantially straight region corresponding to the trailing face 218 of the immediately leading tooth.

Of course, the dimensions provided for the cutting plates 154 hereinabove are merely representative of a particular embodiment of the cutting plates 154. Such dimensions may be changed as one skilled in the art will appreciate according to, e.g., the diameter of such cutting plates 154, and the size of the bone fragments desired from the bone grinder 10. The dimensions provided hereinabove correspond with a tooth height (along a radius from the center point 238 to a tooth edge 222) of approximately ⅛ of an inch between the tooth edge 222 and the area where the corresponding leading face 214 merges into the corresponding convex region 230. Additionally, as shown in FIG. 7, the thickness of the cutting plate 154 is approximately 0.1326 inches which is only slightly larger than ⅛ of an inch. Thus, it is believed that the present dimensions of the embodiment of cutting plates 154 as shown in FIGS. 6 and 7 function within the bone grinder 10 to cuttingly scoop from the input bone segments, bone fragments that are approximately one-eighth inch in size since the cutting teeth 210 cut into the input bone segments a depth of approximately one-eighth of an inch and the width of the cut along the cutting edge 222 is just greater than one-eighth of an inch. Additionally, since the cutting edges 222 on different cutting plates 154 of a grinding assembly 64 are staggered, it is believed that the bone segments input to the grinding assembly 64 are substantially prohibited from both tumbling and shifting during a grinding operation. For example, pressure applied via the plunger 106 reduces a tumbling of the bone segments radially away from grinding shaft axis 170, and the staggered tooth configuration on the contiguous cutting blades 154 reduce lateral movement of the bone segments away from each cutting edge path through the bone segments. That is, regarding such lateral movement, it is believed that since the input bone segments are of sufficient size so that more than one cutting edge 222 may be simultaneously cutting through a bone segment, the bone segment is substantially prohibited from lateral movement away from the cutting and shearing performed by the teeth 210. Accordingly, each tooth 210 is substantially able to gouge or cut out a bone fragment from a substantially immobile input bone material, wherein such fragments are a substantially uniform in size (e.g., one-eighth of an inch).

One skilled in the art will readily understand that the configuration described hereinabove for the cutting plates 154 can be embodied using different dimensions than those cited above for providing a different size of bone fragments. In particular, by changing the height of the teeth 210 and the edge 234 thickness, coarser or finer bone fragments can be generated by the present invention. For example, by replacing a first collection of contiguous cutting plates 154 on the grinding shaft 150 with a second collection of cutting plates having teeth 210 twice as high (e.g., approximately one-quarter of an inch instead of one-eighth of an inch), wherein the thickness of each cutting plate in the second collection is approximately one-quarter of an inch thick, bone fragments of approximately one-quarter of an inch in size may be provided by the present invention. Alternatively, finer bone fragments may be provided by reducing the height of the teeth 210 and narrowing the thickness of the cutting plates 154.

It is a further aspect of the present invention that the cutting plates 154 should have a hardness corresponding to the range of 52 through 56 Rockwell. In particular, one embodiment of the cutting plates 154 are composed of 4-40C stainless steel that has been double drawn. However, it is within the scope of the present invention to utilize other materials such as ceramics for the cutting blades.

Figure 8:
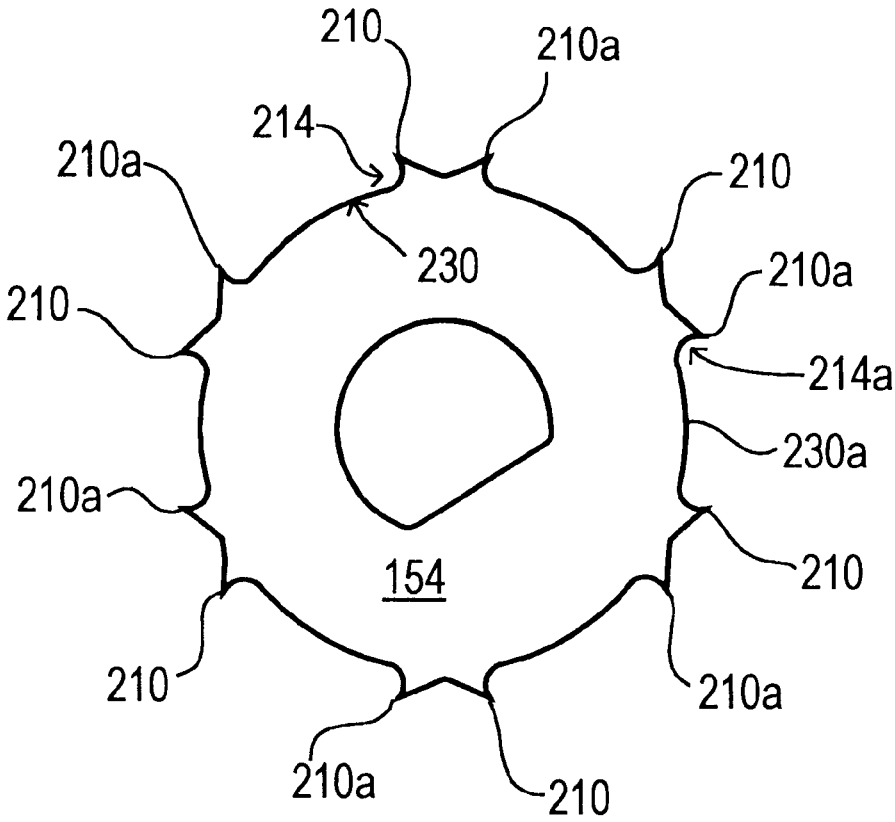
FIG. 8 is an alternative embodiment of a cutting plate 154 having cutting teeth 210 and 210*a* facing in opposite directions of rotation of the cutting plate.

Further, note that in operation, the embodiments of the bone grinder 10 shown hereinabove are such that the cutting plates 154 rotate in a clockwise direction when viewed from the side of the bone grinder 10 shown in FIG. 1, and accordingly, the cutting edges 222 generally point in a clockwise direction in FIG. 1. However, as shown in FIG. 8, it is also within the scope of the present invention that additional cutting teeth 210*a* may be provided on the cutting plates 154, wherein the additional teeth are for cutting in the opposite direction of rotation. Thus, if such additional teeth have a different tooth height (from where their leading faces 214*a* merges into the corresponding convex region 230*a*) than the original teeth 210, then an operator may vary the size of generated bone fragments according to the direction that the crank arm 76 is cranked. For example, ⅛ inch bone fragments may be generated when the crank arm 76 is rotated in the counterclockwise direction, and bone fragments of 1/16 inch in size may be provided when the crank arm is rotated in the clockwise direction.

Moreover, in some embodiments of the present invention, the shape at the teeth 210 (210*a*) may be different from that described above. In particular, teeth with straight or planar leading and trailing faces may be used.

It is also within the scope of the present invention that the pattern of cutting teeth 222 distributed about the grinding assembly 64 may have other configurations than those shown in the figures discussed hereinabove. In particular, the cutting edges 222 may be disbursed in a manner so that no two cutting edges 222 align with one another in the direction of the grinding shaft axis 170. Additionally, such cutting edges 222 may be angled with respect to the grinding shaft axis 170. Moreover, in some embodiments of the present invention, the configuration of cutting edges 222 may be helical on the grinding assembly 64. Further, other embodiments of the present invention may include multiple input portions 110 having different sizes (e.g., diameters) for different sized bone segments. In such an embodiment, a single grinding assembly 64 may be utilized as in the figures described hereinabove, or, the grinding assembly 64 may have two collections of contiguous cutting plates 154 thereon wherein a first of the collections produces bone fragments from a first size of bone segments, and the second collection produces bone fragment from a different second size of bone segments.

In use, the bone grinder of the present invention is placed in or near the operation arena. Bone tissue from a patient, for example, from a patient's rib, is excised from the patient and is then immediately conveyed to the bone shoot of the present device. As the excised bone is fed into the bone shoot, the grinding assembly is operated through the use of a hand crank such that the plurality of cutting plates is set in rotational movement. As the bone comes into contact with such cutting plates, the bone is sliced into appropriately sized particles and/or segments. Such bone particles/segments are collected and are then used by the physician as a type of living mortar to anchor surgical implants into a patient's bone.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A bone grinder, comprising:

a housing having a bone chute therethrough and a chamber intersecting said bone chute, wherein said bone chute has a bone segment entry portion for receiving bone segments, and an exit opening for exiting bone fragments of a predetermined size produced from said received bone segments;

a grinding assembly provided in said chamber, said grinding assembly rotatable about an axis traversing an extent of said bone chute, wherein said grinding assembly includes:

(a) a shaft rotatable about said axis, and (b) a plurality of cutting plates, each plate having opposed first and second sides, a corresponding thickness therebetween and an opening through said thickness of the plates between said opposed sides for matingly receiving said shaft, and at least one cutting edge between said opposed sides for fragmenting said bone segments within said entry portion when said cutting plate rotates with said shaft;

wherein at least two of said cutting plates are adjacent on said shaft so that for said adjacent cutting plates:

(c) said at least one cutting edge on each of said adjacent cutting plates have contiguous cutting paths, and, (d) said at least one cutting edge on both of said adjacent cutting plates are oriented in a same direction for fragmenting said bone segments.

2. The bone grinder of claim 1, wherein said plurality of cutting plates are slidably received on said shaft.

3. The bone cutter of claim 1, wherein said grinding assembly is removable from said housing through an open end of said chamber.

4. The bone grinder of claim 1, wherein said shaft includes a keyed portion thereon for mating with said openings in said cutting plates for maintaining a predetermined alignment of said cutting plates on said shaft.

5. The bone grinder of claim 4, wherein said predetermined alignment includes providing said cutting plates on said shaft in a configuration wherein said cutting edges on different cutting plates contact one of the bone segments substantially simultaneously.

6. The bone grinder of claim 5, wherein for each cutting edge, C, of at least most of said cutting edges there is a corresponding cutting edge on a different one of said cutting plates from the cutting plate including C, wherein C and said corresponding cutting edge are aligned for contacting the bone segments substantially simultaneously.

7. The bone grinder of claim 1, wherein at least one of said cutting plates has a first cutting edge on a rim of said corresponding thickness, said first cutting edge having contiguous leading and trailing faces on said rim, wherein said leading face is concave, said leading face has substantially no portion thereof on a trailing side of a radius from a center point of said at least one cutting plate to said first cutting edge.

8. The bone grinder of claim 7, wherein said leading face merges with a convex portion of said rim that leads said leading face.

9. The bone grinder of claim 1, wherein at least one of said cutting plates includes a plurality of said cutting edges on an outermost rim thereof, wherein each of said plurality of cutting edges has a contiguous leading face that leads the cutting edge when the at least one cutting plate rotates;

wherein for a consecutive two of said cutting edges, $E_1$ and $E_2$, said leading face ($L_2$) for $E_2$ is therebetween, and the following conditions hold:

(i) $L_2$ includes a concave portion of said rim;

(ii) a radius from a center of said at least one cutting plate to $E_2$ is substantially tangent to $L_2$;

(iii) for C being a maximal non-concave curvature of said rim between $E_1$ and $L_2$, and for a portion P on said rim between $E_1$ and $L_2$ wherein said rim has said maximal non-concave curvature C at P, then from P to $E_1$, said rim has no concave portion that has a curvature greater than or equal to C.

10. The bone grinder of claim 9, wherein $E_1$ has a contiguous trailing portion of said rim, and said trailing portion is substantially planar.

11. The bone grinder of claim 9, wherein said curvature C is less than a curvature of $L_2$.

12. The bone grinder of claim 9, wherein no portion of $L_2$ is on a trailing side of the radius from the center of said at least one cutting plate to $E_2$.

13. The bone grinder of claim 9, wherein $L_2$ is entirely non-convex.

14. The bone grinder of claim 13, wherein $L_2$ contacts the radius from the center of said at least one cutting plate to $E_2$ at at most $E_2$.

15. The bone grinder of claim 9, wherein there is a smooth transition from $L_2$ to $E_1$, wherein a maximal curvature corresponds to a radius of approximately 0.046 inches.

16. The bone grinder of claim 9, wherein an angle greater than 50 degrees is between: (a) a radius from a center of said at least one cutting plate to $E_2$, and (b) a trailing portion of said rim that is contiguous to and trails the cutting edge $E_2$ when said at least one cutting plate rotates.

17. The bone grinder of claim 9, wherein said corresponding thickness of said at least one cutting plate and a height of a cutting tooth including $E_1$ have relative proportions to one another so as to separate bone fragments from the bone segments that are approximately a same size as said thickness of said at least one cutting plate.

18. The bone grinder of claim 17, wherein said size is in a range from approximately ⅛ inch to approximately ¼ inch.

19. The bone grinder of claim 17, wherein said corresponding thickness of said at least one cutting plate and said height of said cutting tooth are substantially equal.

20. The bone grinder of claim 1, wherein at least one of said cutting plates has a hardness in a range of 52 to 56 Rockwell.

21. The bone grinder of claim 1, wherein at least one of said cutting plates is composed of 4-40C stainless steel.

22. The bone grinder of claim 21, wherein said 4-40C stainless steel is double drawn.

23. The bone grinder of claim 1, wherein for each cutting plate $C_1$ of at least most of said cutting plates, there is one of said cutting plates $C_2$, wherein $C_1$ and $C_2$ have contiguous cutting paths, and $C_1$ includes a plurality of said cutting edges and said plurality of cutting edges are oriented in a same direction for cutting into said bone fragments as $C_2$.

24. The bone grinder of claim 23, wherein said plurality of said cutting edges of $C_1$ are distributed substantially uniformly about a rim of $C_1$.

25. The bone grinder of claim 1 further including a gear box and a crank arm for manually rotating said shaft, wherein said gear box provides a gear reduction in a range of 2:1 to 4:1.

26. The bone grinder of claim 1, wherein said housing and said grinding assembly are included in a hand-held assembly also including a handle, wherein said hand-held assembly is manually detachable from a base, and wherein said hand-held assembly is operable for grinding bone whether detached from said base or attached to said base.

27. The bone grinder of claim 26 further including a plunger and an operably connected linkage are used to force the bone segments toward and into contact with said grinding assembly, wherein said linkage is also connected to a grip portion for transferring pressure from said grip portion being manually gripped to a force for forcing the bone segments toward and into contact with said grinding assembly.

28. The bone grinder of claim 1, wherein said handle is oriented at approximately 30° to 60° from horizontal when said hand-held assembly is operably attached to said base for grinding bone.

29. The bone grinder of claim 1, wherein for a first of said cutting plates, said first cutting plate is manually replaceable by another cutting plate, wherein said another cutting plate is matingly provided on said shaft in an operable grinding arrangement with at least a second of said cutting plates that was previously matingly received on said shaft with said first cutting plate.

30. A bone grinder, comprising:

a bone chute having an entry portion for receiving bone segments, and an exit opening for exiting bone fragments of a preferred size produced from said received bone segments;

a grinding assembly provided in said chamber, said grinding assembly rotatable about an axis traversing an extent of said bone chute, wherein said grinding assembly includes:

(a) a shaft rotatable about said axis, and (b) at least one cutting plate having a rim with a plurality of cutting edges thereon for cutting fragments of said bone segments within said entry portion when said at least one cutting plate rotates with said shaft;

wherein for a consecutive two of said cutting edges, $E_1$ and $E_2$, there is a leading face ($L_2$) for $E_2$ therebetween, wherein $L_2$ is contiguous to $E_2$, and $L_2$ leads $E_2$ when said cutting plate rotates for grinding; and wherein the following conditions (i) through (iv) hold:

(i) $L_2$ is non-convex, and includes a concave portion of said rim, wherein said concave portion is contiguous to $E_2$;

(ii) substantially all of $L_2$ is on a side, S, of a radius from a center of said cutting plate to $E_2$, wherein S leads $E_2$ when said cutting plate rotates for grinding;

(iii) for C being a maximal non-concave curvature of said rim between $E_1$ and $L_2$, and for a portion P on said rim between $E_1$ and $L_2$, wherein said rim has said maximal non-concave curvature C at P, then from P to $E_1$, said rim has no concave portion that has a curvature greater than or equal to C;

(iv) said curvature C is less than a curvature of said concave portion of $L_2$.

31. The bone grinder of claim 30, wherein there is substantially no curvature of said rim contiguous to $E_1$ from a side of $E_1$ trailing $E_1$ when grinding occurs.

32. A bone grinder, comprising:

a housing having a bone chute therethrough and a chamber intersecting said bone chute, wherein said bone chute has a bone segment entry portion for receiving bone segments, and an exit opening for exiting bone fragments of a predetermined size produced from said received bone segments;

a grinding assembly provided in said chamber, said grinding assembly rotatable about an axis traversing an extent of said bone chute, wherein said grinding assembly includes:

(a) a shaft rotatable about said axis, and (b) a plurality of cutting plates, each plate having opposed first and second sides, a corresponding thickness therebetween and an opening through said thickness of the plates between said opposed sides for matingly receiving said shaft, and at least one cutting edge between said opposed sides for fragmenting said bone segments within said entry portion when said cutting plate rotates with said shaft;

wherein at least two of said cutting plates are adjacent on said shaft so that for said adjacent cutting plates (c) said at least one cutting edge on each of said adjacent cutting plates provides a contiguous cutting path with said at least one cutting edge on the other of said adjacent cutting plates, and, and (d) said at least one cutting edge on both of said adjacent cutting plates are oriented in a same direction for fragmenting said bone segments.

33. A method for grinding bone, comprising:

providing a housing having a bone chute therethrough and a chamber intersecting said bone chute, wherein said bone chute has a bone segment entry portion for receiving bone segments, and an exit opening for exiting bone fragments of a predetermined size produced from said received bone segments;

providing a grinding assembly provided in said chamber, said grinding assembly rotatable about an axis traversing an extent of said bone chute, wherein said grinding assembly includes:

(a) a shaft rotatable about said axis, and (b) a plurality of cutting plates, each plate having opposed first and second sides, a corresponding thickness therebetween and an opening through said thickness of the plates between said opposed sides for matingly receiving said shaft, and at least one cutting edge between said opposed sides for fragmenting said bone segments within said entry portion when said cutting plate rotates with said shaft;

wherein at least two of said cutting plates are adjacent on said shaft so that for said adjacent cutting plates:

(c) said at least one cutting edge on each of said adjacent cutting plates have contiguous cutting paths in said bone chute;

(d) said at least one cutting edge on both of said adjacent cutting plates are oriented in a same direction for fragmenting said bone segments; and (e) grinding bone by placing said bone segments in said bone chute.

34. The bone grinder of claim 33, wherein for each cutting plate $C_1$ of at least most of said cutting plates, there is one of said cutting plates $C_2$ wherein $C_1$ and $C_2$ have contiguous cutting paths, and $C_1$ includes a corresponding plurality of cutting teeth T, each including corresponding one of said cutting edges thereon, and for each of said cutting teeth T, said corresponding cutting edge for T extends further from said shaft than an adjacent portion of said rim of said another cutting plate by an amount substantially corresponding to a height of T.

* * * * *